US010227216B2

(12) United States Patent
Ranger

(10) Patent No.: US 10,227,216 B2
(45) Date of Patent: Mar. 12, 2019

(54) TOOL LIFTING DEVICES, OILFIELD FLANGE LIFTING SAFETY DEVICES, AND RELATED METHODS OF USE

(71) Applicant: Marcus Albert J. Ranger, Sturgeon County (CA)

(72) Inventor: Marcus Albert J. Ranger, Sturgeon County (CA)

( * ) Notice: Subject to any disclaimer, the term of this patent is extended or adjusted under 35 U.S.C. 154(b) by 0 days.

(21) Appl. No.: 15/635,676

(22) Filed: Jun. 28, 2017

(65) Prior Publication Data

US 2017/0369285 A1 Dec. 28, 2017

(30) Foreign Application Priority Data

Jun. 28, 2016 (CA) ..... 2934218
Oct. 17, 2016 (CA) ..... 2945417

(51) Int. Cl.
*B66C 1/28* (2006.01)
*B66C 1/34* (2006.01)
*B66C 1/66* (2006.01)

(52) U.S. Cl.
CPC ..... *B66C 1/28* (2013.01); *B66C 1/34* (2013.01); *B66C 1/66* (2013.01)

(58) Field of Classification Search
CPC .... B66C 1/28; B66C 1/34; B66C 1/36; B66C 1/66; B66C 1/663; B66C 1/666; F16G 15/04; F16G 15/06; E21B 17/00; E21B 19/008
USPC .. 294/82.13, 82.18, 82.22, 82.23, 215, 67.2, 294/67.22, 67.31; 59/86, 88; 278/96
See application file for complete search history.

(56) References Cited

U.S. PATENT DOCUMENTS 228,129 A * 5/1880 Simmons
285,962 A * 10/1883 Bracken
982,556 A * 1/1911 White
1,261,889 A * 4/1918 Zukiwski ..... F16G 15/06 278/96
2,435,336 A * 2/1948 Belvel ..... F16G 15/02 59/86
4,074,519 A * 2/1978 Garrett ..... B66C 1/66 248/499
4,081,954 A * 4/1978 Arnold ..... F16G 15/04 24/581.1
4,538,850 A * 9/1985 De Vito ..... B28B 23/005 24/599.1
5,046,881 A * 9/1991 Swager ..... F16D 25/082 403/154

(Continued)

OTHER PUBLICATIONS

Proline Global, Products Sheet, Aug. 12, 2016, http://www.prolineglobal.com/OurProducts/FlangeProducts/FlangeLiftingTool.aspx.

*Primary Examiner* — Dean J Kramer
(74) *Attorney, Agent, or Firm* — Robert A. Nissen

(57) ABSTRACT

A tool lifting device has: arms connected to pivot relative to one another; and a load bearing pin secured to a first arm of the arms, the arms having a closed position where the load bearing pin is supported by, and spans a tool receiving gap defined between, the arms. A tool lifting device has: arms connected to pivot relative to one another; a load bearing pin supported by one or more of the arms, the arms having a closed position where the load bearing pin extends across a tool receiving gap defined between the arms; and a pivot lock for restricting the arms from pivoting relative to one another in the closed position.

17 Claims, 4 Drawing Sheets

(56) References Cited

U.S. PATENT DOCUMENTS

| | | | | | |
|---|---|---|---|---|---|
| 5,566,999 | A * | 10/1996 | Goettl | B25B 5/101 | 294/103.1 |
| 5,707,168 | A * | 1/1998 | Sharon | B66C 1/62 | 294/67.2 |
| 8,434,800 | B1 | 5/2013 | LeBlanc | | |
| 8,434,801 | B2 * | 5/2013 | LeBlanc | B66C 1/34 | 294/106 |
| 8,899,645 | B2 * | 12/2014 | LeBlanc | B66C 1/28 | 294/106 |
| 8,960,748 | B2 * | 2/2015 | Scott | B25B 27/16 | 248/309.1 |

* cited by examiner

TOOL LIFTING DEVICES, OILFIELD FLANGE LIFTING SAFETY DEVICES, AND RELATED METHODS OF USE

TECHNICAL FIELD

This document discloses tool lifting devices, oilfield flange lifting safety devices, and related methods of use.

BACKGROUND

U.S. Pat. Nos. 8,434,800, 8,434,801, and 8,899,645 disclose flange lifting devices that use freely rotatable members with lifting eyes to support one or more flange bolts passed through a bolt hole of the flange.

SUMMARY

A tool lifting device is disclosed comprising: arms connected to pivot relative to one another; and a load bearing pin supported by one or more of the arms, the arms having a closed position where the load bearing pin extends across a tool receiving gap defined between the arms.

A method is disclosed comprising: lifting a tool with a tool lifting device that supports the tool using a load bearing pin that extends between arms, positioned on either side of the tool, into an opening of the tool; and releasing the tool by pivoting the arms of the tool lifting device.

A tool lifting device is disclosed comprising: arms connected to pivot relative to one another; and a load bearing pin secured to a first arm of the arms, the arms having a closed position where the load bearing pin is supported by, and spans a tool receiving gap defined between, the arms.

A tool lifting device is disclosed comprising: arms connected to pivot relative to one another; a load bearing pin supported by one or more of the arms, the arms having a closed position where the load bearing pin extends across a tool receiving gap defined between the arms; and a pivot lock for restricting the arms from pivoting relative to one another in the closed position.

A method is disclosed comprising: lifting a tool with a tool lifting device that supports the tool using a load bearing pin spanning a pair of arms, positioned on either side of the tool, into an opening of the tool; pivoting a second arm of the arms while the load bearing pin remains in the opening in the tool; and releasing the tool by moving the first arm away from the tool to withdraw the load bearing pin from the opening.

A method is disclosed comprising: engaging a tool within a gap between arms of a tool lifting device, with a load bearing pin extended from a first arm of the arms into an opening in the tool; engaging a pivot lock connecting the arms; lifting the tool with the tool lifting device; disengaging the pivot lock; and releasing the tool by pivoting the arms of the tool lifting device.

In various embodiments, there may be included any one or more of the following features: The load bearing pin is secured to a first arm of the arms. A second arm of the arms defines a pin receiving slot that receives the load bearing pin when the arms are in the closed position. The arms are scissor arms that are connected to pivot about a pivot axis; an axis of the load bearing pin is parallel to the pivot axis; and the pin receiving slot opens into a path of circumferential movement defined by the load bearing pin. The load bearing pin defines a partial or fully circumferential slot that receives a part of the second arm. A pivot lock for restricting the arms from pivoting relative to one another in the closed position. The arms define respective lock openings that align in the closed position to receive the pivot lock. The respective lock openings are offset a pivot axis of the arms. The pivot lock comprises a shackle. The shackle comprises a bight-defining part and a locking pin that is received by aligned apertures at respective ends of the bight-defining part; and the locking pin passes through the respective lock openings of the arms to lock the arms in the closed position. The arms are connected to pivot about a pivot axis; each arm has a tool receiving end and a hoist connecting end; and on each arm the respective lock opening is positioned closer to the hoist connecting end than the pivot axis is. Each arm comprises: a stem part that contacts or is adjacent to the stem part of the other arm, with the stem parts connected to define the pivot axis; an intermediate part extended laterally away from the other arm; and a terminal part that that defines the tool receiving end. Each arm forms a rigid bent sheet. The tool lifting device is connected to a hoisting device. A tool is positioned within the tool receiving gap, and the load bearing pin extended into an opening in the tool. The tool is a flange that has an array of bolt holes, and the load bearing pin extends through one of the bolt holes. The load bearing pin is secured to a first arm of the arms, and in which releasing further comprises: pivoting a second arm of the arms while the load bearing pin remains in the opening in the tool; and moving the first arm away from the tool to withdraw the load bearing pin from the opening. Prior to lifting the tool, engaging a pivot lock to restrict pivoting of the arms relative to one another; and prior to releasing the tool, disengaging the pivot lock. The tool comprises a flange, the opening is a bolt hole opening in the flange, and lifting further comprises: positioning the flange adjacent a flange receiver; and securing the flange to the flange receiver. Positioning an annular gasket between the flange and flange receiver. The flange is a first flange and the flange receiver has a second flange and is located on a valve.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Lifting and rigging refers to the process and equipment used in hoisting objects above the ground. At a job site a team of riggers may install lifting equipment to an object to raise the object using a hoisting device such as a crane, mast, or block and tackle system. Rigging refers to equipment such as wire rope, turnbuckles, clevis, jacks used with cranes and other lifting equipment in material handling and structure relocation. Rigging systems commonly include shackles, master links, slings and lifting bags in under water lifting. Lifting and rigging may present numerous safety hazards for the workers involved.

Many tasks carried out in the oil and gas industry require the rigging and lifting of heavy equipment. One commonly hoisted type of equipment is pipe flange. In some cases, pipe flanges are formed pipe fittings consisting of projecting radial collars with an array of bolt holes to provide a means of attachment to piping components that have a similar fitting. Most oilfield flanges feature a pattern of bolt holes at discrete points along a circular path defined on the face of the flange. Bolt hole patterns of adjacent components align to allow the joint to be secured along with a compressible gasket to ensure a pressure-tight seal. The design and specification of a flange reflects the size and pressure capacity of the equipment to which the flange is fitted.

Often special equipment is needed to lift and install a pipe flange, such as a crane or sling. One known lifting procedure includes securing a lifting eye onto the flange. The lifting eye may serve as a lifting point for the crane hoist or other lifting assembly. Once the flange has been lifted, a worker may manipulate and install the flange by securing the flange to the pipe by inserting bolts into the bolt holes. The lifting eye must then be removed from the flange after installation. Pipe flanges may be found on oil pipelines, Christmas trees valving, and other oil and gas applications. Specialized flange lifting devices are known to be used in the lifting of pipe flanges, such as various devices supplied by PRO-LINE™.

Figure 1:
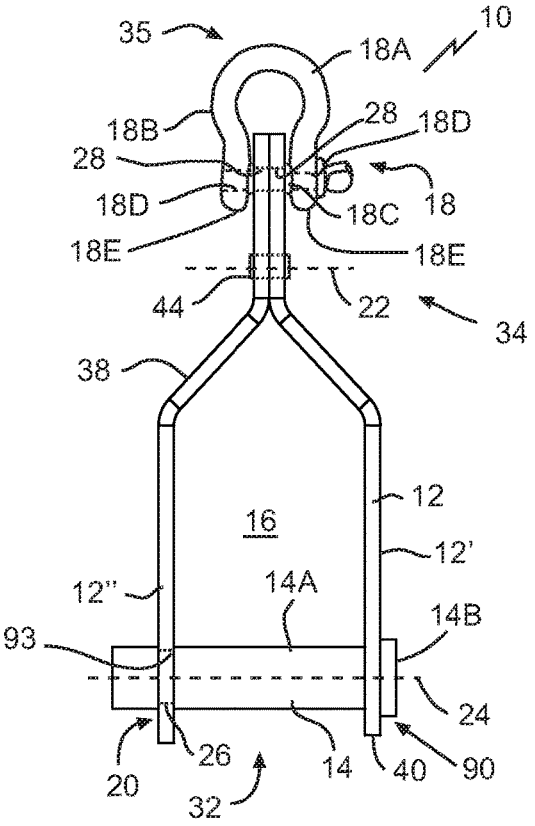
FIG. 1 is a front elevation view of an embodiment of a tool lifting device in a closed position.
Figure 2:
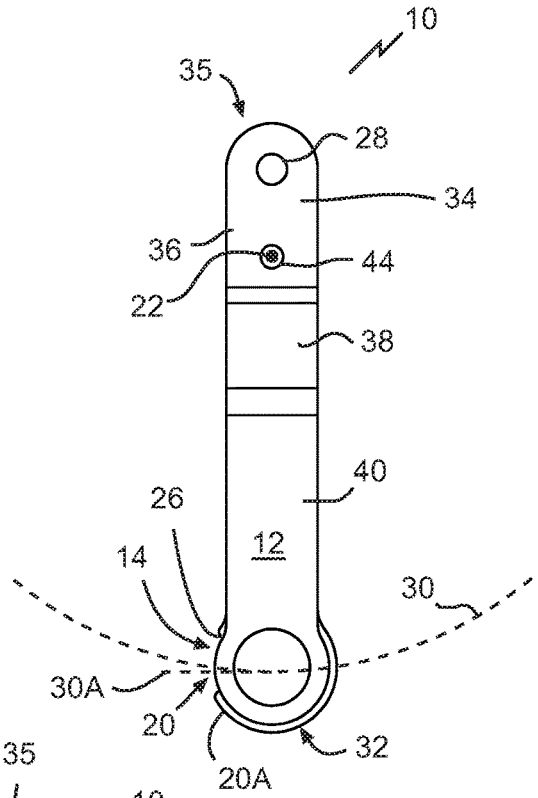
FIG. 2 is a side elevation view of the tool lifting device of FIG. 1.
Figure 3:
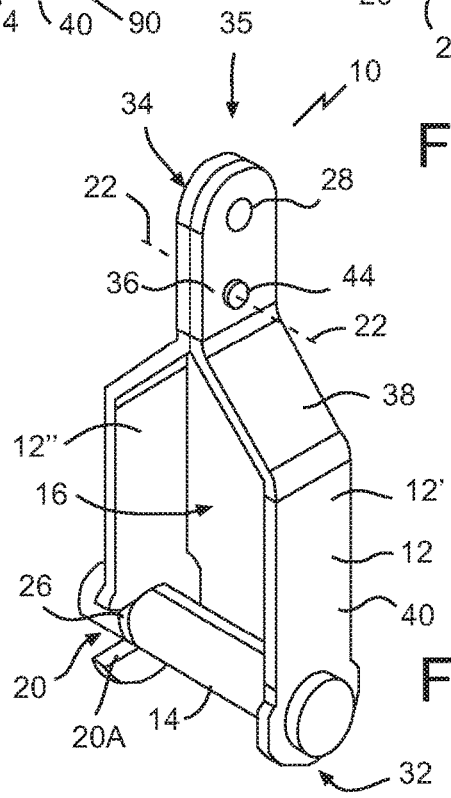
FIG. 3 is a perspective view of the tool lifting device of FIG. 1.
Figure 4:
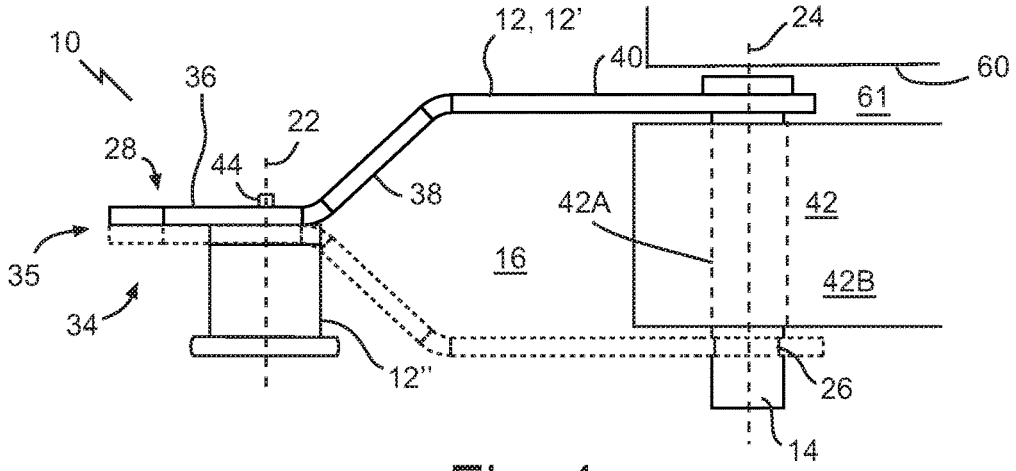
FIG. 4 is a side elevation view of the tool lifting device of FIG. 1, supporting a tool, and illustrating the position of one of the arms in an open position (solid lines), and the closed position (dashed lines).
Figure 6:
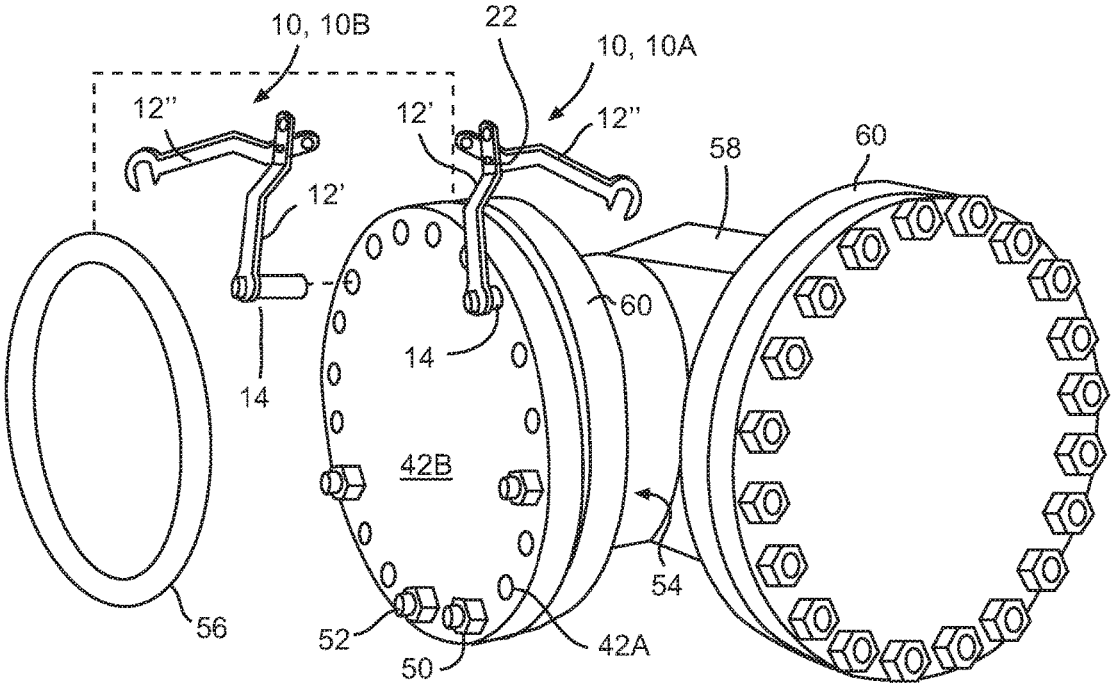
FIG. 6 is an exploded perspective view of the tool lifting device of FIG. 1 illustrating a method step of opening the tool lifting device to remove the device from the flange. The placement of a flange gasket is also shown.

Referring to FIGS. 1-3, a tool lifting device 10 is disclosed comprising arms 12 and a load bearing pin 14. Referring to FIGS. 4 and 6, arms 12 are connected to pivot relative to one another, for example about a pivot axis 22 between an open position (FIG. 6) and a closed position (FIG. 4). In some cases, load bearing pin 14 is supported by one or both of the arms 12. Referring to FIG. 1, while in the closed the load bearing pin 14 may extend across, for example span as shown, a tool receiving gap 16 defined between the arms 12. Referring to FIG. 4, arms 12 may in use be positioned on either side of a tool 42 to be lifted, with the load bearing pin 14 extended from a first arm 12' of the arms 12 into an opening/bolt hole 42A in the tool 42. In some cases the pin 14 spans the arms and is also supported by a second arm 12" of the arms. After the lifting operation is finished, tool 42 may be released by pivoting the arms 12.

Figure 5:
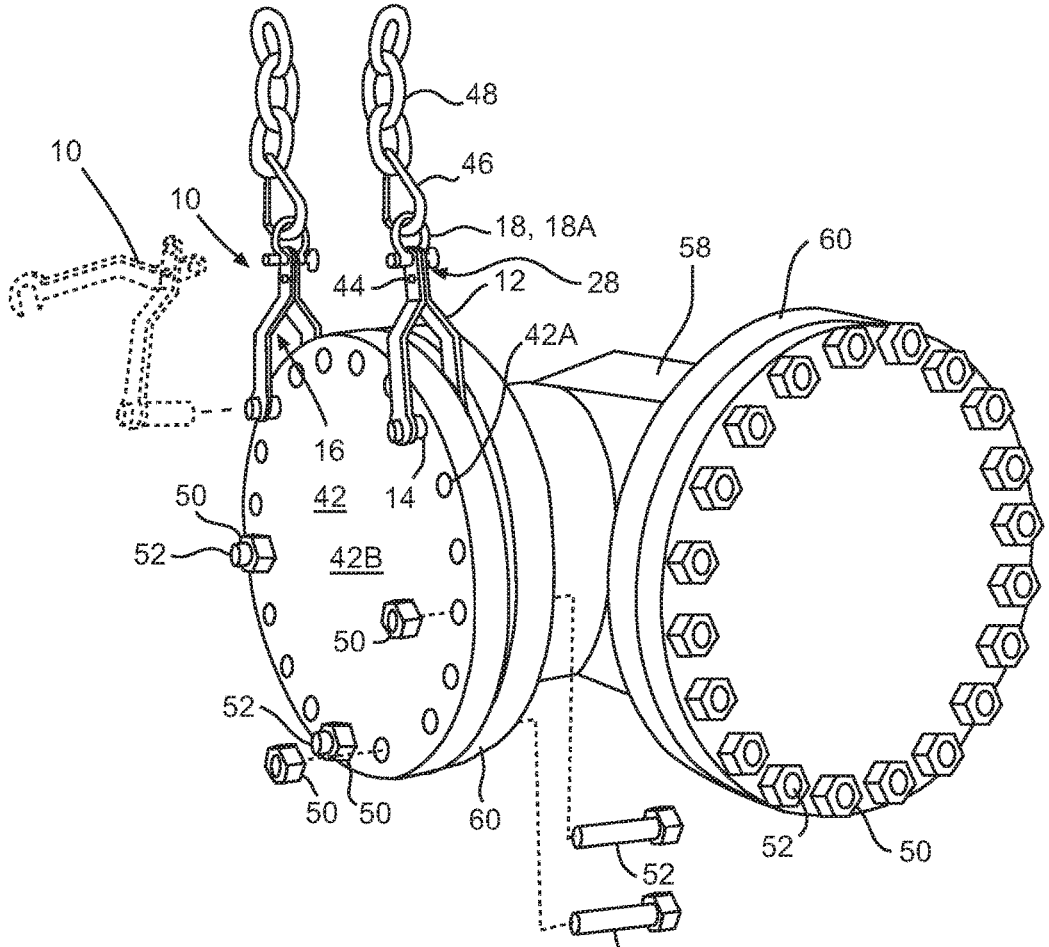
FIG. 5 is an exploded perspective view of the tool lifting device of FIG. 1 illustrating a method of lifting a flange with a hoisting apparatus into a position adjacent a valve, and partially securing the flange and flange receiver using several flange bolts.

Referring to FIG. 1, arms 12 may pivot relative to one another to open or close the tool receiving gap 16, to permit a tool to be inserted, secured, or removed. The pivoting of arms 12 may occur about a pivot axis 22. The pivot axis 22 may be defined as being aligned to the load bearing pin 14. In some cases, the pivot axis 22 is parallel with a longitudinal axis 24 of the load bearing pin 14. Prongs or arms 12 may pivot in a scissor fashion relative to one another about axis 22. Referring to FIG. 4, a scissor style of pivoting action permits the arms 12 to be opened to release the tool 42 even when arm 12' is located within a relative narrow gap 61 defined between tool 42 and an adjacent tool such as flange receiver 60. Referring to FIGS. 1 and 5, pivot axis 22 may be defined by a pivot pin 44. Pivot pin 44 may be suitable device that permits up to 360 degrees of rotation about axis 22, for example pivot pin 44 may be a clevis pin. In other cases (not shown), arms 12 may pivot in a non-scissor fashion, for example a jaw-like motion where tips of the jaws move toward and away from one another to bit a tool. Pivot axis 22 may be arranged in a suitable orientation, such as in cases where axis 22 is other than parallel to axis 24, for example perpendicular to the axis 24.

Referring to FIGS. 1-3, arms 12 may have an appropriate shape to accommodate a tool. Each of first and second arms 12' and 12" may comprise a stem part 34, and intermediate part 38, and a terminal part 40. The stem part 34 of one arm 12 may contact the stem part 34 of the opposing arm 12. In some cases, stem part 34 is adjacent but spaced from the opposing stem part 34. Stem parts 34 may be connected to define pivot axis 22. Stem part 34 may comprise pivot pin 44 which may span between the respective stem parts 34 of arms 12' and 12". Each stem part 34 may define a pivot pin opening 44A, such that openings 44A align or not to fit a straight or bent pivot pin 44. Each arm 12 may comprise an intermediate part 38, for example that spaces the arm 12 away from pivot pin 44. Intermediate part 38 may extend laterally from the opposing arm 12. A separation between intermediate parts 38 may increase in width with increasing distance from pivot pin 44, with each intermediate part 38 forming a shoulder. Each intermediate part 38 may connect between a respective stem part 34 and a respective terminal part 40. Each terminal part 40 may mount or support the load bearing pin 14. Terminal parts 40 may collectively define the tool receiving gap 16. Each terminal part 40 may define a tool receiving end 32 of arm 12, and each stem part 34 may define a hoist connecting end 35.

Referring to FIG. 4, each of the arms 12 may take a suitable form, such as that of a rigid bent sheet. A sheet may have a relatively narrow thickness, thus permitting the tool 42 to be positioned in use closely adjacent another tool, such as flange receiver 60. In some cases, device 10 comprises more than two arms 12 to provide additional contact points and support for a single pin 14 or to support multiple load-bearing pins. In some cases one of the arms is flat, while the other is bent as shown, and in some cases both arms have distinct shapes from one another.

Referring to FIGS. 1-4 the load bearing pin 14 may be secured in a suitable fashion to first arm 12'. Referring to FIG. 1, the pin 14 may comprise a smooth bore 14A and an end flange 14B. The bore 14A passes through an opening 90 in arm 12', which is sized to form a stop for seating end flange 14B as shown. A further part (not shown), such as a split ring on the pin 14 adjacent the side of arm 12' opposite the side that the end flange 14B contacts, may be provided to lock the pin 14 to the first arm 12' to prevent removal of the pin 14 from the arm 12'. In some cases bore 14A is threaded. In some cases the pin 14 is secured to first arm 12' by threading to the first arm 12'.

Referring to FIG. 1, the load bearing pin 14 may extend across, for example at least partially or full across (shown), tool receiving gap 16. The pin 14 may be supported by first arm 12', or arm 12' and second arm 12". In use, load bearing pin 14 forms a surface that bears the weight of tool 42.

Referring to FIGS. 2 and 3, second arm 12" may define a pin receiving slot 20 that receives the load bearing pin 14 when the arm 12" swings into the closed position. Referring to FIG. 2, the pin receiving slot 20 may open into a path 30 of circumferential movement defined by the load bearing pin 14. Slot 20 may form a mouth that laterally opens in the direction of a tangent 30A along the path 30 of circumferential movement. Referring to FIG. 3, slot 20 may comprise a base ledge 20A that supports the pin 14 during weight bearing that occurs during lifting and rigging.

Referring to FIGS. 1 and 3, the pin 14 may be shaped to mate with the second arm 12". In one case the load bearing pin 14 defines a slot, for example a partial or fully (shown) circumferential slot 26 that receives a part 93 of the second arm 12". Part 93 may form part of slot 20 of second arm 12". The slot 26 may engage with the second arm 12" during use to grip and restrict any pull out or push through axial forces that act through the pin 14 against the second arm 12". Instead of a slot 26, other suitable structures may be used to restrict such movement and support the pin 14, for example using a shoulder, or a tapered portion, for example defined by a part (not shown) of pin bore 14A that gets wider or narrower with increasing distance from end flange 14B.

Referring to FIG. 1, device 10 may comprise a pivot lock 18 for restricting, for example locking, the arms 12 against rotation. Pivot lock 18 may restrict the arms 12 from pivoting relative to one another when the device 10 is in the closed position. Pivot lock 18 may lock the device by a suitable mechanism, such as by inserting a part through respective openings 28 defined by the arms 12. In some cases, each opening 28 is defined by a respective stem part 36. The lock openings 28 may be located closer to the hoist connecting end 35 than the pivot axis 22 is. When the device is in the closed position, openings 28 may be aligned and the pivot lock 18 may be insertable through openings 28. In some cases, pivot lock 18 comprises a pin 18C that is inserted into the aligned openings 28 to lock the arms 12. Prior to lifting a tool, pivot lock 18 may be engaged to restrict pivoting of the arms relative to one another and such may allow for safer operation of the flange during lifting. Prior to releasing the tool the pivot lock may be disengaged to allow the arms 12 to be swung into the open position and the device 10 to be removed from the tool.

Referring to FIG. 1, the pivot lock 18 may comprise a lifting shackle 18A. The shackle 18A may permit the device 10 to be locked while simultaneously providing a mechanism for which the device 10 may be attached to a lifting device, such as a crane. The shackle 18A may comprise a bight defining part 18B, such as a clevis as shown, that is shaped to engage with a chain or hook, for example a U-shape, V-shape, D-shape or suitable shapes, including twisted shapes. Shackle 18A may comprise a locking pin 18C that is received by aligned apertures 18D at respective ends of the bight defining part 18B. The locking pin 18C may pass through the respective lock openings 28 of the arms 12 to lock the arms 12 in the closed position. In use, a worker may place the bight defining part 18B on either side of the device 10, with the ends 18E of the part 18B flanking the arms 12. Next, the worker may insert and secure, for example by threading as shown, the locking pin 18C into engagement with ends 18E. The pin 18C may also thread to openings 28. The locking pin 18C may have a threaded end and smooth bore, or threaded end and bore. Any suitable shackle may be used, for example, an anchor, bow, twist, D-shackle, headboard, pin, snap, or threaded shackle. Suitable locking pins may be used, for example a twist clevis or twist shackle. Other types of non-shackle pivot locks may also be used, for example fasteners such as bolts.

Referring to FIG. 5, in use tool lifting device 10 may be connected to a hoist in order to lift, position, and secure a tool to another part. In the example shown in FIGS. 5-7, the device 10 is used to position a pipe flange 42B into place on a flange receiver 60 of an oilfield valve 58, so that the flange 42B may be secured and sealed to the flange receiver 60. Two or more devices 10 may be used to balance the load of the flange 42B. The devices 10 may be positioned at suitable locations on the flange 42B, for example with the left device 10 positioned between 7 and 11 o'clock, for example between 9 and 10 o'clock, and the right device 10 positioned between 5 and 1 o'clock, for example between 2 and 3 o'clock.

Referring to FIG. 5, in an initial stage the flange 42B is engaged within gaps 16 between sets of arms 12 of devices 10. Engagement may be carried out by inserted the pins 14 of each device 10 into respective bolt holes 42A in the flange 42B. The arms 12 of devices 10 may then be pivoted to close the arms 12 around the flange 42B. The pivot locks may be engaged, for example by connecting shackles 18A to each device 10. The shackles 18A may then be connected to a hoisting device such as a crane, which may suspend a suitable tether such as a pair of lifting chains 48 or cables, each fitted with a shackle connector such as a hook 46. The hooks 46 may be secured to the shackles 18A, and the flange 42B lifted by applying tension through the chains 48 to raise the flange 42B. The crane may be operated to position the flange 42B into a desired position, for example adjacent a flange receiver 60, which has a flange that corresponds to the flange 42B, of an oilfield part such as a valve 58. Referring to FIG. 5, while the flange 42B is supported by the crane, a user may align the bolt hole patterns on the flange 42B and flange receiver 60, and place several bolts 52, for example at positions near a base of the flange 42B. Nuts 50 may be connected to secure the bolts 52 in place, for a loose connection at this point.

Figure 7:
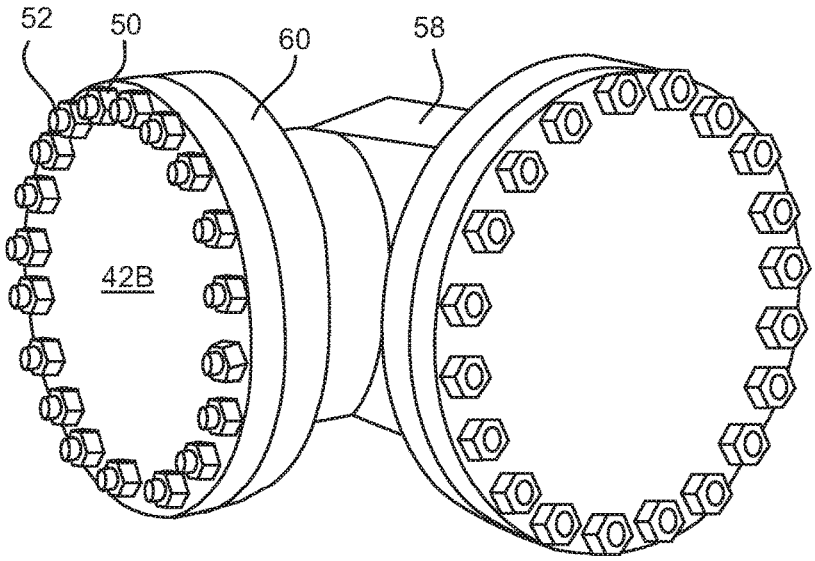
FIG. 7 is a perspective view of the valve of FIG. 5 with the flange fully secured to the flange receiver.

Once the flange 42B is independently supported by the bolts 52, the devices 10 may be removed. Referring to FIG. 6, the removal process may be started by disengaging the pivot lock, for example by removing the shackles 18A from each device 10. Afterward, both flanges 42B may be released by swinging the arms into an open position where the non-pin-mounting arm 12" is clear of the flange 42B and the pins 14 of arms 12' remain in the respective bolt holes 42A. The devices 10 may be moved away from the flange 42B to withdraw the pins 14 from the respective bolt holes 42A. An annular gasket 56 may be slid into the gap between the flange 42B and the flange receiver 60. Referring to FIG. 7, the remaining bolts 52 may then be inserted between aligned bolt hole patterns of flange 42B and receiver 60, and nuts 50 used to tightly secure and seal the flanges together to complete the connection. A process to remove the flange 42B from the receiver 60 may be achieved by carrying out some or all of the steps in reverse.

Figure 8:
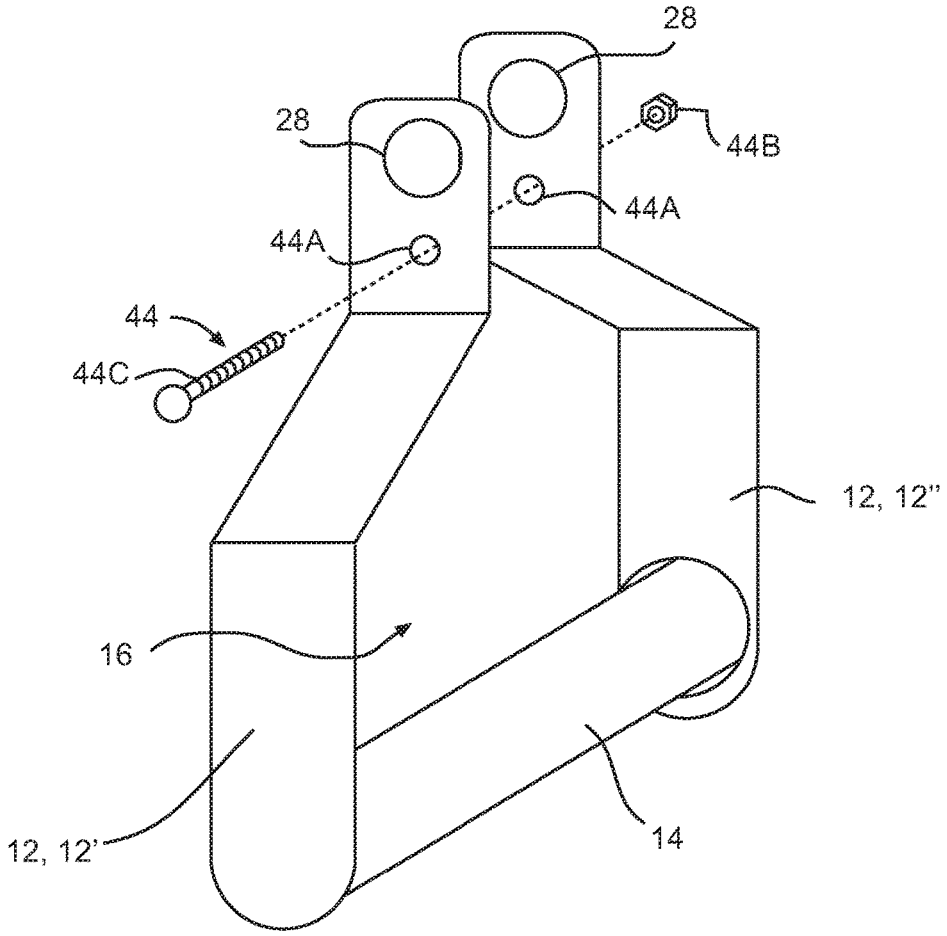
FIG. 8 is a perspective view of a further embodiment of a tool lifting device with a removable pivot pin.

Pins 14 may be replaced with flange bolts in some cases. Non-shackle pivot locks may be used, such as a cap that mounts over the hoist connecting ends 35 of arms 12, or a band or cable that wraps around the stem parts of the arms. Lever arms may be used to secure the arms 12 together. Aligned openings 28 are not required to achieve a pivot lock. In one case one arm 12 mounts a spring-biased pin that aligns with an opening in the other arm to engage and create a pivot lock, which can be disengaged by applying pressure against the biasing force of the pin to remove the pin from the opening and permit the arms 12 to be pivoted out of the closed position. The flange 42B may be a blind flange. In other cases the flange 42B may be part of process equipment such as a valve, or piece of piping. The load bearing pin 14 may be retractable. In one case a pair of seven pound devices 10 were able to lift a tool of over 1700 pounds, with each device 10 rated at 850 pounds. Referring to FIG. 6, a pair of left and right handed devices 10B and 10A may be used, such that both devices can be inserted into and removed from the same flange face, while permitting the respective swing arms 12" to swing in opposite directions, in this example outward, to avoid obstruction with interior components such as gasket 56. The devices 10 may be made of QT 100 Steel, which is durable in cold weather applications, such as in cases where the ambient temperature is at or below minus forty Celsius. The devices 10 disclosed here may be used in any lifting applications, and in some cases pulling or pushing applications as well, and including oil and gas lifting, fabrication lifting, and use in association with a picker truck. The devices 10 may be used with tether cranes, or with devices that pull or push via rigid tethers. In some cases the devices 10 may be used to eliminate the use of slings and pin bars. The devices 10 may fit into a conventional tool carrier device, such as a tool box. No lifting eye may be required. Referring to FIG. 8 a further embodiment of a device 10 is illustrated with a pivot lock formed by a bolt 44C and nut 44B combination as a pivot pin 44, and a pivot pin 14 that fits into a circular opening in arm 12".

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A tool lifting device comprising:

arms, which are scissor arms that are connected to pivot relative to one another about a pivot axis;

a load bearing pin secured to a first arm of the arms, with the load bearing pin defining a pin axis that during pivoting is parallel to the pivot axis of the arms, the arms having a closed position where the load bearing pin extends across a tool receiving gap defined between the arms, in which a second arm of the arms defines a pin receiving slot that receives the load bearing pin when the arms are in the closed position, with the pin receiving slot opening into a path of circumferential movement defined by the load bearing pin; and in which the arms define respective lock openings that each define a respective axis that is offset relative to the pivot axis of the arms, such that the respective openings slide across one another during pivoting of the arms to align in the closed position to receive a pivot lock to restrict the arms from pivoting relative to one another when the arms are in the closed position.

2. The tool lifting device of claim 1 in which the load bearing pin defines a partial or fully circumferential slot that receives a part of the second arm.

3. The tool lifting device of claim 1 in which the pivot lock comprises a shackle.

4. The tool lifting device of claim 3 in which:

the shackle comprises a bight-defining part and a locking pin that is received by aligned apertures at respective ends of the bight-defining part; and the locking pin passes through the respective lock openings of the arms to lock the arms in the closed position.

5. The tool lifting device of claim 1 in which:

each arm has a tool receiving end and a hoist connecting end; and on each arm the respective lock opening is positioned closer to the hoist connecting end than the pivot axis is.

6. The tool lifting device of claim 5 in which each arm comprises:

a stem part that contacts or is adjacent to the stem part of the other arm, with the stem parts connected to define the pivot axis;

an intermediate part extended laterally away from the other arm; and a terminal part that that defines the tool receiving end.

7. The tool lifting device of claim 1 in which each arm forms a rigid bent sheet.

8. The tool lifting device of claim 1 connected to a hoisting device.

9. The tool lifting device of claim 1 with a tool positioned within the tool receiving gap, and the load bearing pin extended into an opening in the tool.

10. The tool lifting device of claim 9 in which the tool is a flange that has an array of bolt holes, and the load bearing pin extends through one of the bolt holes.

11. The tool lifting device of claim 1 in which the respective axes of the respective openings are parallel to the pivot axis.

12. A method comprising:

inserting a load bearing pin into an opening of a tool, the load bearing pin being secured to a first arm of a pair of scissor arms connected to pivot relative to one another, the load bearing pin and pair of scissor arms forming a tool lifting device;

pivoting a second arm of the scissor arms relative to the first arm such that a pin receiving slot defined in the second arm receives the load bearing pin, with the second arm engaging a partial or fully circumferential slot defined in the load bearing pin, in which the load bearing pin extends across a tool receiving gap defined between the scissor arms;

lifting the tool with the tool lifting device using the load bearing pin 1; and releasing the tool by: pivoting the second arm such that the pin receiving slot disengages the load bearing pin while the load bearing pin remains in the opening in the tool; and withdrawing the load bearing pin from the opening.

13. The method of claim 12 further comprising:

prior to lifting the tool, engaging a pivot lock to restrict pivoting of the arms relative to one another; and prior to releasing the tool, disengaging the pivot lock.

14. The method of claim 12 in which the tool comprises a flange, the opening is a bolt hole opening in the flange, and lifting further comprises:

positioning the flange adjacent a flange receiver; and securing the flange to the flange receiver.

15. The method of claim 14 further comprising positioning an annular gasket between the flange and flange receiver.

16. The method of claim 14 in which the flange is a first flange and the flange receiver has a second flange and is located on a valve.

17. A tool lifting device comprising:

arms, which are scissor arms that are connected to pivot relative to one another about a pivot axis;

a load bearing pin supported by one or more of the arms, the arms having a closed position where the load bearing pin extends across a tool receiving gap defined between the arms, with the load bearing pin defining a pin axis that during pivoting is parallel to the pivot axis of the arms;

a pivot lock for restricting the arms from pivoting relative to one another in the closed position; and in which each arm has a tool receiving end and a hoist connecting end, and on each arm a respective lock opening is positioned closer to the hoist connecting end than the pivot axis is;

in which each arm comprises:

a stem part that contacts or is adjacent to the stem part of the other arm, with the stem parts connected to define the pivot axis;

an intermediate part extended laterally away from the other arm; and a terminal part that that defines the tool receiving end.

* * * * *